US006589304B1

(12) United States Patent
Nakagawa et al.

(10) Patent No.: US 6,589,304 B1
(45) Date of Patent: Jul. 8, 2003

(54) METHOD OF BONDING POROUS ABRASIVE SOLID MASS TO BASE MEMBER WITH PROVISION OF SEALING FILM ON BONDING SURFACE OF THE ABRASIVE SOLID MASS

(75) Inventors: Toshimichi Nakagawa, Nagoya (JP); Kazumasa Yoshida, Niwa-gun (JP); Tomoharu Kondo, Nagoya (JP)

(73) Assignee: Noritake Co., Ltd., Nagoya (JP)

( * ) Notice: Subject to any disclaimer, the term of this patent is extended or adjusted under 35 U.S.C. 154(b) by 0 days.

(21) Appl. No.: 10/217,649

(22) Filed: Aug. 14, 2002

(51) Int. Cl.[7] ..... B24D 3/00; B24D 3/10; B24D 3/58; B24D 3/28; B24D 18/00

(52) U.S. Cl. ..... 51/307; 51/295; 51/298; 51/308; 51/309; 51/293

(58) Field of Search ..... 51/295, 298, 307, 51/308, 309, 293

(56) References Cited

U.S. PATENT DOCUMENTS 3,900,976 A * 8/1975 Kitts, Jr. ..... 451/494
4,021,208 A * 5/1977 Oberbichler ..... 51/295

FOREIGN PATENT DOCUMENTS

JP A 10-316952 12/1998
JP A 11-300626 11/1999

* cited by examiner

*Primary Examiner*—Michael Marcheschi
(74) *Attorney, Agent, or Firm*—Oliff & Berridge, PLC

(57) ABSTRACT

A method of bonding an abrasive solid mass to a desired member with an adhesive, wherein the abrasive solid mass has a porous abrasive structure in which a multiplicity of abrasive grains are held together by a bonding agent. The method includes a sealing-film forming step of forming a sealing film on a surface of the abrasive solid mass, for preventing the adhesive from penetrating into pores formed in the porous abrasive structure.

12 Claims, 7 Drawing Sheets

FIG. 2

| MATERIAL | MAJOR COMPONENT | SOFTENING POINT (°C) | COEFFICIENT OF LINEAR THERMAL EXPANSION (/°C) |
|---|---|---|---|
| LEAD-BASED GLASS | $PbO-B_2O_3$ | 375 | $4.7\times10^{-6}$ |
| TIN-PHOSPHATE-BASED GLASS | $SnO-P_2O_5$ | 340 | $5.5\times10^{-6}$ |

PRIOR ART

METHOD OF BONDING POROUS ABRASIVE SOLID MASS TO BASE MEMBER WITH PROVISION OF SEALING FILM ON BONDING SURFACE OF THE ABRASIVE SOLID MASS

BACKGROUND OF THE INVENTION

1. Field of the Invention

The present invention relates in general to a method of bonding a porous abrasive solid mass to a desired member and a method of manufacturing a grindstone or grinding wheel. More particularly, the present invention is concerned with techniques for preventing an adhesive from penetrating into pores of the porous abrasive solid mass when the porous abrasive solid mass is bonded to the base member.

2. Discussion of the Related Art

There is known a grinding wheel including: a base disk; and a multiplicity of abrasive segment chips which are fixed to the base disk so as to be arranged on a circle whose center corresponds to the axis of the base disk. In a grinding operation with this grinding wheel, the base disk is rotated about the axis, so that a workpiece is ground by the abrasive segment chips. One example of such a grinding wheel is disclosed in JP-A-H11-300626 (publication of unexamined Japanese Patent Application laid open in 1999). In such a grinding wheel, it is common that the abrasive segment chips are bonded to the base disk with an epoxy resin adhesive or other adhesive as in the example disclosed in JP-A-H10-316952 (publication of unexamined Japanese Patent Application laid open in 1998).

However, where each of the abrasive segment chips has a porous abrasive structure such as a vitrified CBN abrasive structure in which super abrasive grains of cubic-crystal boron nitride are held together by a vitrified bond, the adhesive used for bonding the abrasive segment chips to the base disk is likely to penetrate into pores of the porous abrasive structure, thereby deteriorating a grinding capacity of the grinding wheel.

FIG. 6 shows a segment-chip-type grinding wheel 100 in which a multiplicity of arcuate abrasive segment chips 104 are disposed on an outer circumferential surface of a base disk 102 having an axis O, with a minimized gap between each adjacent pair of the abrasive segment chips 104 as viewed in a circumferential direction of the base disk 102. The arcuate abrasive segment chips 104 are bonded to each other and also to the outer circumferential surface of the base disk 102 by a suitable adhesive 105. Owing to the minimized gap between each adjacent pair of the abrasive segment chips 104, the abrasive segment chips 104 can be successively brought into contact with a workpiece, thereby making it possible to grind the workpiece with a high machining accuracy. However, if each of the abrasive segment chips 104 has a porous abrasive structure in which abrasive grains 106 are held together by bond bridges 108 as a boding agent and in which a multiplicity of pores 110 are formed between the abrasive grains 106, as shown in FIG. 7, the adhesive 105 is likely to penetrate into the pores 110 after the adhesive 105 is applied to the abrasive segment chips 104. That is, since the adhesive 105 inherently has a certain degree of fluidity before the adhesive 105 is hardened or cured, the adhesive 106 very probably penetrates into the pores 110, whereby a volume ratio of the pores 110 to the abrasive grains 106 is reduced, particularly, in circumferentially opposite end portions of each abrasive segment chip 104.

Thus, the actual volume ratio of the pores 110 to the abrasive grains 106 tends to be smaller than a target volume ratio which is predetermined depending upon a kind of workpiece to be ground by the grinding wheel 100 and a desired grinding condition in which the workpiece is ground by the grinding wheel 100. Each abrasive segment chip 104 has, in its opposite end portions, relatively dense abrasive structure portions in which the volume ratio of the pores 110 to the abrasive grains 106 is relatively small, so that the dense abrasive structure portions of the abrasive segment chips 104 are intermittently brought into contact with the workpiece during a grinding operation with the grinding wheel 100. The dense abrasive structure portions provide a larger grinding resistance than the other portions. Further, the dense abrasive structure portions are poor in a so-called self-sharpening capability or spontaneous edge-forming capability for spontaneously restoring sharpness of each abrasive grain 106. Therefore, the opposite end portions of each abrasive segment chip 104 (that are located near joint lines at which each abrasive segment chip 104 is bonded to the adjacent abrasive segment chips 104) are likely to be worn in a larger amount than the other portions, and are likely to be broken with a larger possibility than the other portions, so that the abrasive segment chips 104 are brought into contact with the workpiece in an intermittent manner rather than in a successive manner. The intermittent contact of the abrasive segment chips 104 with the workpiece causes a periodic vibration, which might cooperate with a proper vibration of a grinding machine to cause a resonance vibration, thereby deteriorating a machining accuracy.

In general, the adhesive tends to penetrate into the pores located in a radially inner portion of each abrasive segment chip 104 (at which portion each abrasive segment chip 104 is bonded to the base disk 102), as well as into the pores located in the circumferentially opposite end portions of each abrasive segment chip 104. That is, each abrasive segment chip 104 has the relatively dense abrasive structure portion also in its radially inner portion. As the outside diameter of the grinding wheel 100 is reduced, namely, as a radially outer portion of each abrasive segment chip 104 is worn as a result of repeated use of the grinding wheel 100, the dense abrasive structure portion is eventually exposed to an outer circumferential surface of each abrasive segment chip 104, so that the dense abrasive structure portion is brought into contact with the workpiece, for thereby causing glazing on the outer circumferential surface of each abrasive segment chip 104 and accordingly deteriorating a machining accuracy. This problem is encountered not only in the segment-chip-type grinding wheel 100 as shown in FIG. 6 but also in other type of grinding wheels such as a tubular-body-type grinding wheel 124 as shown in FIG. 8 in which a tubular abrasive body 120 as the porous abrasive solid mass is bonded to an arbor 122 as the base member with an adhesive.

SUMMARY OF THE INVENTION

It is therefore an object of the present invention to provide techniques for preventing an adhesive which is used for bonding a porous abrasive solid mass to a desired member, from penetrating into pores of the porous abrasive solid mass, so as to avoid deterioration of a grinding capacity of the abrasive solid mass. This object of the invention may be achieved according to any one of the first through twelfth aspects of the invention which are described below.

The first aspect of this invention provides a method of bonding an abrasive solid mass to a desired member with an adhesive, wherein the abrasive solid mass has a porous abrasive structure in which a multiplicity of abrasive grains are held together by a bonding agent, the method comprising: a sealing-film forming step of forming a sealing film on a surface of the abrasive solid mass, for preventing the adhesive from penetrating into pores which are located between the abrasive grains in the porous abrasive structure. It is noted that the above-described desired member may be provided by a base member such as a base disk or cylindrical base body, or may be provided by another abrasive solid mass.

According to the second aspect of the invention, the method defined in the first aspect of the invention further comprising a bonding step of bonding the abrasive solid mass to the desired member with the adhesive, by heating the adhesive up to a predetermined setting temperature, wherein the sealing film is formed of a material having a softening point or temperature which is lower than a softening point or temperature of the bonding agent and which is higher than the predetermined setting temperature.

According to the third aspect of the invention, in the method defined in the first or second aspect of the invention, the sealing film is formed of a material having a coefficient of linear thermal expansion of $(a\pm2)\times10^{-6}$ (/° C.) while the abrasive solid mass has a coefficient of linear thermal expansion of $a\times10^{-6}$ (/° C.), where "a" represents a value larger than 0 and smaller than 10 ($0<a<10$).

According to the fourth aspect of the invention, in the method defined in any one of the first through third aspects of the invention, the sealing film includes a lead based glass as a major component thereof.

According to the fifth aspect of the invention, in the method defined in any one of the first through third aspects of the invention, the sealing film includes a tin-phosphate based glass as a major component thereof.

According to the sixth aspect of the invention, in the method defined in any one of the first through fifth aspects of the invention, the sealing-film forming step includes: a sub-step of preparing a mixture of a liquid and a powder including a lead based glass as a major component thereof, a sub-step of applying said mixture onto the surface of the abrasive solid mass; a sub-step of drying the mixture applied onto the surface of the abrasive solid mass; and a sub-step of heating the mixture up to a predetermined temperature that is higher than a softening temperature of the lead based glass, so that the sealing film is formed on the surface of the abrasive solid mass.

According to the seventh aspect of the invention, in the method defined in any one of the first through fifth aspects of the invention, the sealing-film forming step includes: a sub-step of preparing a mixture of a liquid and a powder including a tin-phosphate based glass as a major component thereof; a sub-step of applying said mixture onto the surface of the abrasive solid mass; a sub-step of drying the mixture applied onto the surface of the abrasive solid mass; and a sub-step of heating the mixture up to a predetermined temperature that is higher than a softening temperature of the tin-phosphate based glass, so that the sealing film is formed on the surface of the abrasive solid mass.

The eighth aspect of this invention provides a method of manufacturing a grindstone which includes a base member, and at least one abrasive solid mass bonded to the base member with an adhesive, each of the above-described at least one abrasive solid mass having a porous abrasive structure in which a multiplicity of abrasive grains are held together by a bonding agent, the method comprising: a sealing-film forming step of forming a sealing film on each of the above-described at least one abrasive solid mass, for preventing the adhesive from penetrating into pores which are located between the abrasive grains in the porous abrasive structure.

According to the ninth aspect of the invention, in the method defined in the eighth aspect of the invention, the base member consists of a base disk, wherein the above-described at least one abrasive solid mass consists of a plurality of abrasive segment chips arranged with substantially no spacing between each adjacent pair of the abrasive segment chips which are bonded at respective bonding surfaces thereof to each other by the adhesive, and wherein the sealing film is formed on the bonding surfaces of each adjacent pair of the abrasive segment chips in the sealing-film forming step, before each adjacent pair of the abrasive segment chips are bonded to each other.

According to the tenth aspect of the invention, in the method defined in the eighth aspect of the invention, the base member consists of a cylindrical base body, wherein the above-described at least one abrasive solid mass consists of a tubular abrasive body mounted on the cylindrical base body such that the tubular abrasive body is bonded at a bonding surface thereof to the cylindrical base body by the adhesive, and wherein the sealing film is formed on the bonding surface of the tubular abrasive body in the sealing-film forming step, before the tubular abrasive body is bonded to the cylindrical base body.

According to the eleventh aspect of the invention, in the method defined in any one of the eighth through tenth aspects of the invention, the porous abrasive structure of each of the above-described at least one abrasive solid mass consists of a vitrified abrasive structure in which cubic-crystal boron nitride (CBN) abrasive grains as the multiplicity of the abrasive grains are held together by a vitrified bond as the bonding agent.

According to the twelfth aspect of the invention, in the method defined in any one of the eighth through tenth aspects of the invention, the porous abrasive structure of each of the above-described at least one abrasive solid mass consists of a vitrified abrasive structure in which diamond abrasive grains as the multiplicity of the abrasive grains are held together by a vitrified bond as the bonding agent.

In the abrasive-solid-mass bonding method defined in the first aspect of the invention, the sealing film is formed on the surface of the abrasive solid mass at which surface the abrasive solid mass is bonded to the desired member, for preventing the abrasive solid mass from being impregnated with the adhesive, so that the pores of the abrasive solid mass are prevented from being filled with the adhesive when the abrasive solid mass is bonded to the desired member. That is, the formation of the sealing film on the surface of the abrasive solid mass is effective to prevent a reduction in the volume ratio of the pores to the abrasive grains in local portions of the abrasive solid mass, namely, prevent formation of dense abrasive structure portions which would increase a grinding resistance and deteriorate a self-sharpening capability or spontaneous edge-forming capability of the abrasive grains. Accordingly, the abrasive solid mass, which is bonded to the desired member according to the invention, is advantageously prevented from suffering from uneven wear and easy breakage or chipping.

In the abrasive-solid-mass bonding method defined in the second aspect of the invention in which the sealing film is formed of the material having the softening temperature lower than the softening temperature of the bonding agent of the abrasive solid mass, there is no risk of deterioration of the bonding agent in a heating process for coating the surface of the abrasive solid mass with the sealing film. Further, since the softening temperature of the material of the sealing film is higher than the predetermined setting temperature at which the abrasive solid mass is bonded to the desired member with the adhesive, there is no risk of melting or damage of the sealing film when the abrasive solid mass is bonded to the desired member at the predetermined setting temperature, so that the adhesive is reliably prevented from penetrating into the pores of the abrasive solid mass.

In the abrasive-solid-mass bonding method defined in the third aspect of the invention in which the sealing film is formed of the material having the coefficient of linear thermal expansion substantially equal to that of the abrasive solid mass, the sealing film is prevented from being distorted and also prevented from being provided with a residual stress due to its thermal expansion or contraction in the heating process of coating the surface of the abrasive solid mass with the sealing film.

In the abrasive-solid-mass bonding method defined in the fourth or fifth aspect of the invention in which the sealing film is formed of a lead-based or tin-phosphate based glass as its major component, the abrasive solid mass is reliably protected by the vitreous sealing film from the adhesive. The lead-based or tin-phosphate based glass has a softening temperature of about 300–450° C., which is sufficiently lower than a softening temperature of the bonding agent of the porous abrasive solid mass (for example, the softening temperature of the bonding agent will be about 600° C. where the bonding agent is constituted by a vitrified bond), so that the surface of the abrasive solid mass can be coated with the sealing film without deteriorating a bonding strength with which the abrasive grains are held together by the bonding agent, and so that the adhesive can be provided by an epoxy resin adhesive or any other adhesive which has a setting temperature not larger than about 150° C. Further, since the lead-based or tin-phosphate-based glass has a coefficient of linear thermal expansion of the order of $10^{-6}$ (/° C.), which is close to a coefficient of linear thermal expansion of the vitrified abrasive solid mass, the sealing film is prevented from being distorted and also prevented from being provided with a residual stress due to its thermal expansion or contraction in the heating process of coating the surface of the abrasive solid mass with the sealing film. Where the abrasive solid mass has a vitrified CBN abrasive structure in which super abrasive grains of cubic-crystal boron nitride are held together by a vitrified bond, the coefficient of linear thermal expansion of the abrasive solid mass will be of about $5\times10^{-6}$ (/° C.), so that the sealing film is preferably formed of the lead-based or tin-phosphate-based glass as its major component.

In the abrasive-solid-mass bonding method defined in the sixth or seventh aspect of the invention, the mixture of the liquid and the powder including the lead-based or tin-phosphate-based glass as its major component is prepared, and the thus prepared mixture is then applied onto the surface of the abrasive solid mass. After the applied mixture is dried, the mixture is heated up to the predetermined temperature that is higher than the softening temperature of the lead-based or tin-phosphate-based glass, so that the sealing film is formed on the surface of the abrasive solid mass. In this method, the porous abrasive solid mass having a multiplicity of pits and projections in its surface is easily coated with the sealing film such that the sealing film has a, thickness that is small and substantially constant over its entirety.

The grindstone manufacturing method defined in the eighth aspect of the invention may be carried out together with the technical features defined in any one of the above-described first through seventh aspects of the invention.

In the grindstone manufacturing method defined in the ninth aspect of the invention, the sealing film is formed on the bonding surfaces of each adjacent pair of the abrasive segment chips at which surfaces the adjacent pair of abrasive segment chips are bonded to each other by the adhesive, for thereby effectively preventing the adhesive from penetrating into the pores of each abrasive segment chip. That is, the formation of the sealing film on the bonding surfaces of each pair of the abrasive segment chips is effective to prevent a reduction in the volume ratio of the pores to the abrasive grains in the portions located near joint lines (at which each abrasive segment chip is bonded to the adjacent abrasive segment chips), namely, prevent formation of dense abrasive structure portions which would increase a grinding resistance and deteriorate a self-sharpening capability or spontaneous edge-forming capability of each abrasive segment chip. Accordingly, each abrasive segment chip is advantageously prevented from suffering from uneven wear and easy breakage, which would cause the abrasive segment chips to be brought into contact with the workpiece in an intermittent manner. That is, in the grindstone manufactured according to the method of this ninth aspect of the invention, it is possible to prevent such an intermittent contact of the abrasive segment chips with the workpiece, thereby avoiding generation of a vibration unfavorable for maintaining a machining accuracy.

In the grindstone manufacturing method defined in the tenth aspect of the invention, the sealing film is formed on the bonding surface of the tubular abrasive body at which surface the tubular abrasive body is bonded to the cylindrical base body by the adhesive, for thereby effectively preventing the adhesive from penetrating into the pores of the tubular abrasive body. That is, the formation of the sealing film on the bonding surface of the tubular abrasive body is effective to prevent a reduction in the volume ratio of the pores to the abrasive grains in a radially inner portion of the tubular abrasive body. Therefore, even after a radially outer portion of the tubular abrasive body is worn as a result of repeated use of the grindstone, namely, even after the outer circumferential surface of the grindstone becomes close to the cylindrical base body (as the base member) as a result of reduction in the outside diameter of the grindstone, the grindstone can maintain its grinding capacity, without suffering from glazing on the outer circumferential surface of the grindstone and deterioration in the machining accuracy, which would be caused if the pores of the tubular abrasive body had been filled with the adhesive.

In the grindstone manufacturing method defined in the eleventh or twelfth aspect of the invention, the porous abrasive structure is provided by the vitrified abrasive structure in which the cubic-crystal boron nitride abrasive grains or diamond abrasive grains are held by the vitrified bond. The grindstone in which the abrasive solid mass has the thus constructed vitrified abrasive structure is capable of performing a grinding operation at a high grinding rate with a high accuracy. In such a high-rate grinding operation, a grinding performance of the grindstone would be easily affected by variation in the abrasive structure which might be caused if the abrasive solid mass had been impregnated with the adhesive. However, owing to the provision of the sealing film which prevents the adhesive from penetrating into the pores of the abrasive solid mass, the grindstone reliably exhibits the excellent grinding performance even in the high-rate grinding operation.

The principle of the invention described above is advantageously applicable to, particularly, a method of manufacturing a grindstone including a base disk and a multiplicity of abrasive segment chips which are fixed to the base disk so as to be arranged without gap therebetween on a circle whose center corresponds to the axis of the base disk, so that grindstone is rotated about the axis, for thereby grinding a workpiece with the abrasive segment chips. However, the invention can be applied also to a method of manufacturing any other type of grindstone in which the abrasive solid mass has a porous abrasive structure. Further, the invention can be applied to a method of manufacturing a plate-shaped grindstone, which is reciprocated along a straight line rather than being rotated, for grinding a workpiece. It is noted that the above-described abrasive segment chips may be fixed to an outer circumferential surface of the base disk, or alternatively, may be fixed to an end surface of the base disk that is perpendicular to the axis of the base disk.

The abrasive solid mass or abrasive segment chip may be provided by only an abrasive layer which is constituted in its entirety by the abrasive structure, or alternatively, may be provided not only by the abrasive layer but also by a support layer which is constituted by an inorganic or ceramic material in place of the abrasive grains. In the latter case, the abrasive solid mass or abrasive segment chip is bonded, at the support layer rather than at the abrasive layer, to the base member.

In the ninth aspect of the invention, the sealing film may be formed not only on the above-described bonding surfaces at which each adjacent pair of the abrasive segment chips are bonded to each other, but also on a bonding surface at which each abrasive segment chip is bonded to the base disk. However, where each abrasive segment chip includes the above-described support layer in addition to the abrasive layer, the sealing film does not have to be formed on the bonding surface at which each abrasive segment chip is bonded to the base disk, since the support layer protects the abrasive layer from being impregnated with the adhesive. Further, also where each abrasive segment chip is fixed to the base disk by a screw bolt or other fixing means without using the adhesive, the sealing film does not have to be formed on the above-described bonding surface. Still further, even where the abrasive segment chip provided by only the abrasive layer is fixed to the base disk with the adhesive, the formation of the sealing member on the above-described bonding surface is not essential unless the grindstone is used even after the outer circumferential surface of the grindstone becomes close to the base disk.

The abrasive solid mass or abrasive segment chip has a grinding surface which should not covered with the sealing film so as to be brought into direct contact with a workpiece in a grinding operation. However, in the sealing-film forming step of the manufacturing process, the grinding surface, together with the bonding surface, may be coated with the sealing film. In this case, a portion of the sealing film covering the grinding surface can be removed, for example, by grinding the portion of the sealing film in a process implemented after the sealing-film forming step, so that the grinding surface can be brought into direct contact with a workpiece in a grinding operation.

The porous abrasive structure of the abrasive solid mass or abrasive segment chip may be advantageously provided by a vitrified abrasive structure in which super abrasive grains (such as diamond abrasive grains and CBN abrasive grains having a considerably high degree of hardness) or standard abrasive grains (such as alumina and silicon carbide) are held together by a vitrified bond. However, the porous abrasive structure may be provided by any abrasive structure other than the vitrified abrasive structure.

Each of the above-described at least one abrasive solid mass defined in the eighth aspect of the invention may consist of a plate body, or alternatively may consist of a tubular body as defined in the tenth aspect of the invention. The base member defined in the eighth aspect of the invention may consist of a plate body, a disk body or a cylindrical body, and may be formed of a metal, ceramic, synthetic resin or any other material.

While the material of the sealing film defined in the third aspect of the invention has a coefficient of linear thermal expansion of $(a\pm2)\times10^{-6}$ (/° C.), it is more preferable that the coefficient of linear thermal expansion of the material is $(a\pm1)\times10^{-6}$ (/° C.), where "a" represents a value larger than 0 and smaller than 10 ($0<a<10$).

It is preferable that the thickness of the sealing film is, minimized for permitting the sealing film to be held in close contact with the surface of the porous abrasive solid mass or segment chip which has the pits and projections, so that the porous abrasive solid mass or segment chip can be firmly bonded to the desired member via the sealing member. However, the thickness of the sealing member may be held in such a range that provides a required degree of bonding strength with which the abrasive solid mass or segment chip is bonded to the desired member.

While the adhesive is provided by preferably an epoxy resin adhesive, the adhesive may be provided by an acrylic resin or any other adhesive.

BRIEF DESCRIPTION OF THE DRAWINGS

The above and other objects, features, advantages and technical and industrial significance of this invention will be better understood by reading the following detailed description of the presently preferred embodiments of the invention, when considered in connection with the accompanying drawings, in which:

FIG. 2 is a view showing physical properties of examples of glasses each of which can be used for forming the sealing film on a surface of each abrasive segment chip in a process of manufacturing the grinding wheel of FIGS. 1A and 1B;

DETAILED DESCRIPTION OF THE PREFERRED EMBODIMENT

Figure 1A:
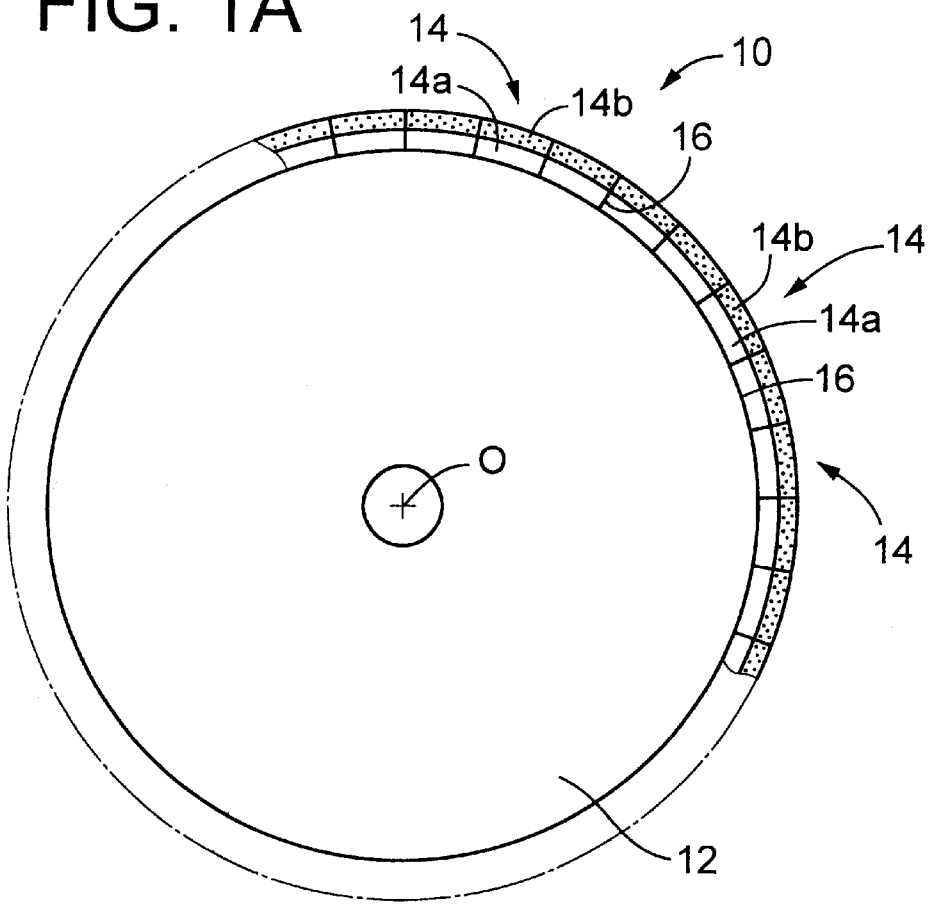
FIG. 1A is a front elevational view of a grindstone in the form of a segment-chip-type grinding wheel, which is constructed according to one embodiment of the invention.

FIG. 1A is a front elevational view of a grindstone in the form of a segment-chip-type grinding wheel 10 which is constructed according to a first embodiment of the invention. The grinding wheel 10 has a base member in the form of a base disk 12 having an axis O, and a plurality of abrasive solid mass in the form of arcuate abrasive segment chips 14 which are arranged on an outer circumferential surface of the base disk 12, with substantially no gap between each pair of the abrasive segment chips 14 which are contiguous to each other as viewed in a circumferential direction of the base disk 12. The arcuate abrasive segment chips 14 are bonded to the outer circumferential surface of the base disk 12 by a suitable adhesive 16, while each pair of the contiguous abrasive segment chips 14 are bonded to each other by the suitable adhesive 16. The base disk 12 is formed of a metal, ceramic or synthetic resin. Each of the arcuate abrasive segment chips 14 has radially outer and inner surfaces in the form of arcuate surfaces which lie on respective circles having a common center at the axis O of the base disk 12. Each of the arcuate abrasive segment chips 14 has a radially inner layer in the form of a support layer 14*a* which is bonded to an outer circumferential surface (cylindrical surface) of the base disk 12, and a radially outer layer in the form of an abrasive layer 14*b* which is disposed radially outwardly of the support layer 14*a* and which is to be brought into contact with a workpiece during a grinding operation with the grinding wheel 10.

Figure 1B:
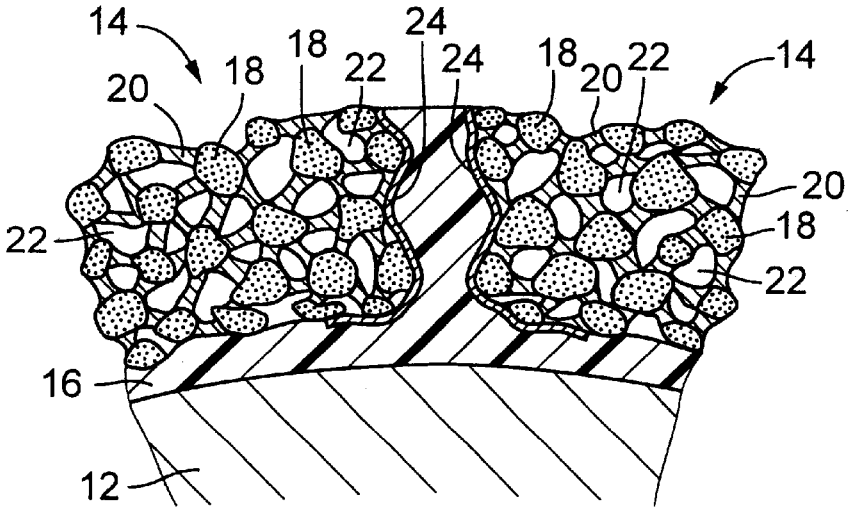
FIG. 1B is a cross sectional view of an outer peripheral portion of the segment-chip-type grinding wheel of FIG. 1A, showing abrasive segment chips each of which is coated with a sealing film.

FIG. 1B is a cross sectional view of an outer peripheral portion of the segment-chip-type grinding wheel 10, which view is taken in a plane perpendicular to the axis O. The abrasive layer 14*b* of each abrasive segment chip 14 is constituted by a porous abrasive structure in which a multiplicity of super abrasive grains 18 (e.g., CBN abrasive grains) are held together by bond bridges 20 formed of a vitrified bond. In the porous structure, a multiplicity of voids or pores 22 are formed between the super abrasive grains 18. The support layer 14*a* is provided by a structure in which the super abrasive grains 18 are replaced with other inorganics. Each abrasive segment chip 14 has circumferentially opposite end portions at which the abrasive segment chip 14 are bonded to the respective adjacent abrasive segment chips 14 with the adhesive 16. Each of the circumferentially opposite end portions is coated with a sealing film 24 which has a small thickness (e.g. about 10–200 $\mu$m) and which is formed of a lead-based or tin-phosphate-based glass. This sealing film 24 is provided for preventing the adhesive 16 from penetrating into the pores 22 of the abrasive segment chip 14 before the adhesive 16 is hardened or cured.

FIG. 2 is a view showing major components, softening points (softening temperatures) and other physical properties of the lead-based glass and the tin-phosphate-based glass which are used to form the sealing film 24. As is apparent from FIG. 2, the softening points of the lead-based glass and the tin-phosphate-based glass are about 375° C. and 340° C., respectively, which are sufficiently lower than a softening point of the vitrified bond as the bonding agent of each abrasive segment chip 14 and are higher than a predetermined setting temperature of the epoxy resin adhesive 16. The softening point of the vitrified bond and the predetermined setting temperature are about 600° C. and 150° C., respectively. The lead-based glass and the tin-phosphate-based glass have respective coefficients of linear thermal expansion of $4.7\times10^{-6}$ (/° C.) and $5.5\times10^{-6}$ (/° C.), which are substantially equal to a coefficient of linear thermal expansion of the abrasive segment chip 14 constituted by the porous vitrified abrasive structure in which the CBN abrasive grains are held together by the vitrified bond. The coefficient of linear thermal expansion of the abrasive segment chip 14 is about $5\times10^{-6}$ (/° C.).

Figure 3A:
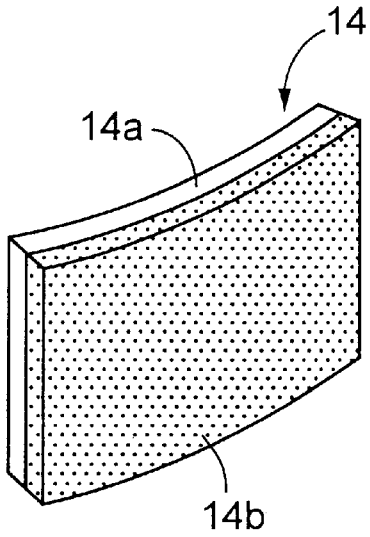
FIGS. 3A–3D are views illustrating the process of manufacturing the grinding wheel of FIG. 1A and 1B.
Figure 3B:
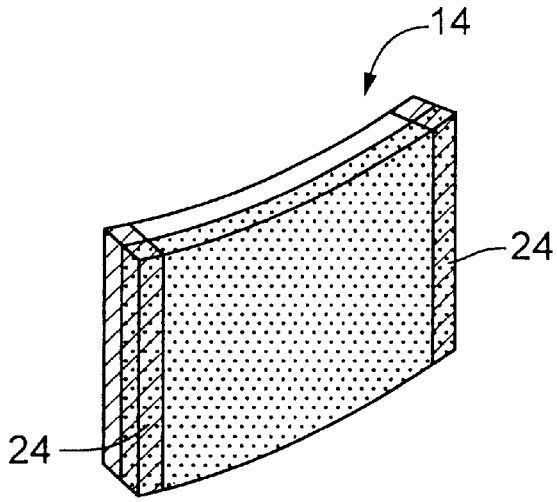
Figure 3C:
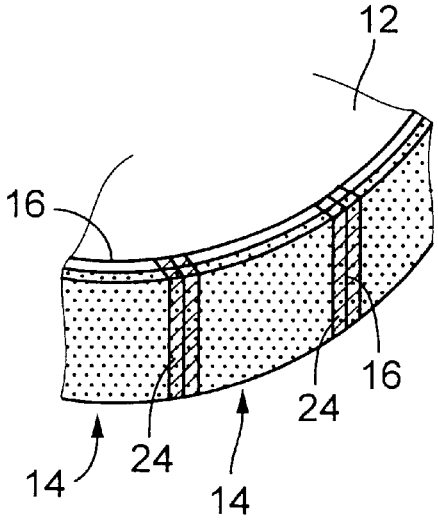
Figure 3D:
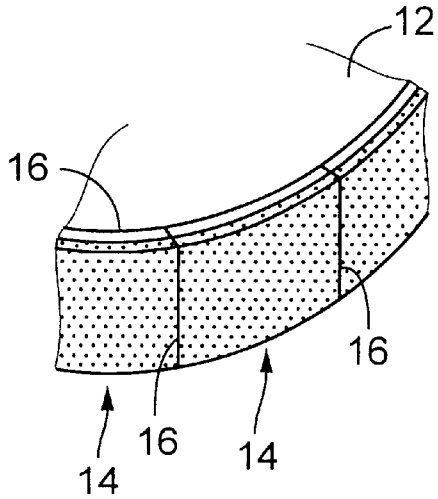

The segment-chip-type grinding wheel 10 is manufactured in a manufacturing process illustrated in FIGS. 3A–3D. The process is initiated with a segment-chip forming step of forming the abrasive segment chip 14, as shown in FIG. 3A. The segment-chip forming step is followed by a sealing-film forming step in which the sealing film 24 is formed on each of the circumferentially opposite end portions of the abrasive segment chip 14, as shown in FIG. 3B. A bonding step is then implemented to bond the multiplicity of abrasive segment chips 14 onto the outer circumferential surface of the base disk 12 with the adhesive 16, as shown in FIG. 3C. The bonding step is followed by a finishing step which is implemented to eliminate a difference in level between the surfaces of each adjacent pair of abrasive segment chips 14, as shown in FIG. 3D.

The segment-chip forming step of FIG. 3A is implemented in a known manner for forming an abrasive solid mass having a vitrified CBN abrasive structure. The sealing-film forming step of FIG. 3B includes: a sub-step of preparing a mixture of a liquid (e.g. water) and a powder including a lead-based or tin-phosphate-based glass as its major component; a sub-step of applying the mixture onto each abrasive segment chip 14 in a dipping or brushing manner; a sub-step of drying the mixture applied onto the abrasive segment chip 14 and then removing an over-applied or superfluous portion of the mixture from the abrasive segment chip 14, by using a brush; and a sub-step of heating the mixture up to a predetermined temperature (e.g., about 500° C.) that is higher than the softening temperature of the lead-based or tin-phosphate-based glass, and then holding the predetermined temperature for a predetermined time (e.g., 30 minutes), so as to bake the mixture on the abrasive segment chip 14. In this sealing-film forming step, the sealing film 24 is formed not only on each of longitudinally opposite end surfaces of the abrasive segment chip 14 but also on an outer circumferential surface and a side surface of each of longitudinally opposite end portions of the abrasive segment chip 14. This is because the adhesive 16, which is intended to be applied onto the longitudinally opposite end surfaces and the inner circumferential surface of the abrasive segment chip 14 in the bonding step, is likely to be forced out onto the outer circumferential surface and the side surface of the abrasive segment chip 14 when the abrasive segment chip 14 is bonded to the base disk 12. It is noted that the sealing film 24 does not have to be formed on the inner circumferential surface of the abrasive segment chip 14, because the inner circumferential surface of the abrasive segment chip 14 is included in the support layer 14*a* which does not provide the grinding surface to be brought into contact with the workpiece.

In the bonding step of FIG. 3C, the adhesive 16 is first applied onto the longitudinally opposite end surfaces and the inner circumferential surface of each of the multiplicity of abrasive segment chips 14. The multiplicity of abrasive segment chips 14 are then arranged on the outer circumferential surface of the base disk 12, and are heated up to a predetermined setting temperature (e.g., 150° C.), for curing the applied adhesive 16 so that the abrasive segment chips 14 are bonded to each other and to the base disk 12. In this instance, the adhesive 16 may be applied onto the outer circumferential surface of the base disk 12, in place of the inner circumferential surface of each abrasive segment chip 14. The finishing step of FIG. 3D is implemented to eliminate the difference in level between the surfaces of each adjacent pair of the abrasive segment chips 14, and also to remove the adhesive 16 and the sealing film 24 remaining on the outer circumferential surfaces and the side surfaces of the abrasive segment chips 14, by using a finishing grinding wheel, a diamond dresser or other suitable tool. The segment-chip-type grinding wheel 10 is thus manufactured.

In the above-described method of manufacturing the segment-chip-type grinding wheel 10, the sealing film 24 is formed on each of the longitudinally opposite end surfaces of each abrasive segment chip 14 at which surfaces the abrasive segment chip 14 is bonded to the adjacent abrasive segment chips 14 with the adhesive 16, for preventing the abrasive segment chips 14 from being impregnated with the adhesive 16, so that the pores 22 of the abrasive segment chips 14 are prevented from being filled with the adhesive 16 when the abrasive segment chips 14 are bonded to each other. That is, the formation of the sealing film 24 on each of the longitudinally opposite end surfaces of each abrasive segment chip 14 is effective to prevent a reduction in the volume ratio of the pores 22 to the abrasive grains 18 in local portions of each abrasive segment chip 14, namely, prevent formation of dense abrasive structure portions which would increase a grinding resistance and deteriorate a self-sharpening capability or spontaneous edge-forming capability of the abrasive grains 18 of each abrasive segment chip 14. Accordingly, each abrasive segment chip 14 is advantageously prevented from suffering from uneven wear and easy breakage, which would cause the abrasive segment chips 14 to be brought into contact with the workpiece in an intermittent manner. That is, in the grinding wheel 10 manufactured according to the above-described method, it is possible to prevent such an intermittent contact of the abrasive segment chips 14 with the workpiece, thereby avoiding generation of a vibration unfavorable for maintaining a machining accuracy.

In the above-described manufacturing method, the porous abrasive structure of each abrasive segment chip 14 is provided by the vitrified abrasive structure in which the CBN abrasive grains are held by the vitrified bond. The grinding wheel 10 in which each abrasive segment chip 14 has the thus constructed vitrified abrasive structure is capable of performing a grinding operation at a high grinding rate with a high accuracy. In such a high-rate grinding operation, a grinding performance of the grinding wheel 10 would be easily affected by variation in the abrasive structure which might be caused if the abrasive segment chip 14 had been impregnated with the adhesive 16. However, owing to the provision of the sealing film 24 which prevents the adhesive 16 from penetrating into the pores 22 of the abrasive segment chip 14, the grinding wheel 10 reliably exhibits the excellent grinding performance even in the high-rate grinding operation.

In the above-described manufacturing method in which the sealing film 24 is formed of a lead-based or tin-phosphate based glass as its major component, each abrasive segment chip 14 is reliably protected by the vitreous sealing film from the adhesive 16. The lead-based or tin-phosphate based glass has the softening temperature of about 375° C. or 340° C., which is sufficiently lower than the softening temperature (about 600° C.) of the vitrified bond and which is sufficiently higher than the predetermined setting temperature (about 150° C.) of the epoxy resin adhesive 16, so that each abrasive segment chip 14 can be coated with the sealing film 24 without deteriorating a bonding strength with which the abrasive grains 18 are held together by the bonding agent, and so that the epoxy resin adhesive 16 can be heated up to the predetermined setting temperature for bonding the abrasive segment chips 14 to each other and to the base disk 12, without melting or damaging the sealing film 24.

Further, since the lead-based or tin-phosphate-based glass has the coefficient of linear thermal expansion of about $4.7\times10^{-6}$ (/° C.) or $5.5\times10^{-6}$ (/° C.), which is close to the coefficient of linear thermal expansion (about $5\times10^{-6}$ (/° C.)) of each abrasive segment chip 14 having the vitrified CBN abrasive structure, the sealing film 24 is substantially prevented from being distorted and also substantially prevented from being provided with a residual stress due to its thermal expansion or contraction in the heating process of coating the surfaces of each abrasive segment chip 14 with the sealing film 24.

The sealing-film forming step of the above-described manufacturing method includes the sub-step of preparing the mixture of the liquid (e.g. water) and the powder including the lead-based or tin-phosphate-based glass as its major component; the sub-step of applying the mixture onto each abrasive segment chip 14; the sub-step of drying the mixture and then removing the over-applied or superfluous portion of the mixture from the abrasive segment chip 14; and the sub-step of heating the mixture up to the predetermined temperature (e.g., about 500° C.) that is higher than the softening temperature of the lead-based or tin-phosphate-based glass so as to bake the mixture on the abrasive segment chip 14. In this method, each abrasive segment chip 14 having a multiplicity of pits and projections in its surfaces is easily coated with the sealing film 24 such that the sealing film 24 has a thickness that is small and substantially constant over its entirety.

A grinding performance test was conducted by using the above-described segment-chip-type grinding wheel 10 and a conventional segment-chip-type grinding wheel which is identical with the grinding wheel 10 except that abrasive segment chips are bonded to each other and to a base disk without a sealing film covering each abrasive segment chip. In the test, grinding operations were performed with the grinding wheel 10 and the conventional grinding wheel, in the following conditions:

[Conditions]

Type of grinding operation: Plunge grinding using a grinding fluid (soluble grinding liquid)

Type of solid abrasive mass: CB80M+200V Workpiece: Cylindrical workpiece made of SCM435 (JIS standard)

Peripheral speed of grinding wheel: 80 m/sec

Figure 4:
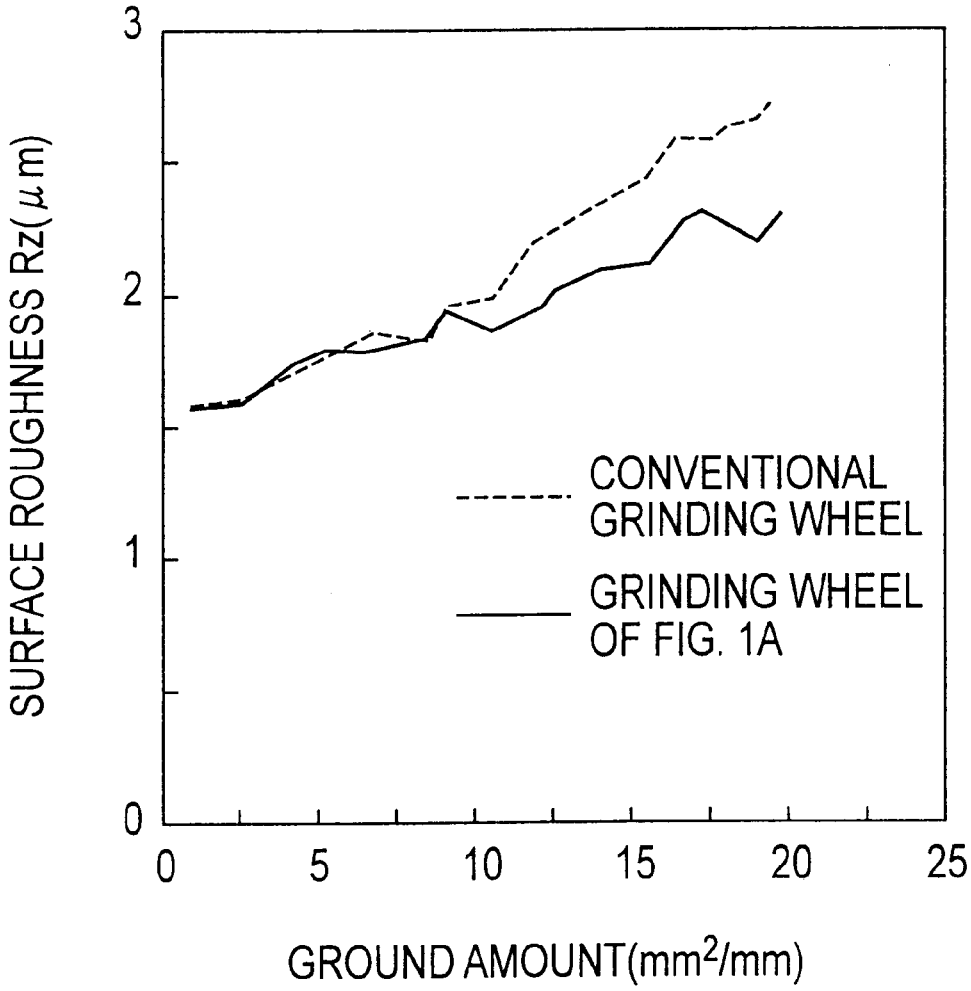
FIG. 4 is a graph indicating results of a grinding performance test of the grinding wheel of FIG. 1A and a conventional grinding wheel in which the abrasive segment chips are bonded to each other without the sealing film.

FIG. 4 is a graph indicating results of the test, showing change in a surface roughness (ten point height of irregularities) Rz ($\mu$m) of the workpiece, which change was confirmed with an increase in a ground amount ($mm^2$/mm). As is apparent from FIG. 4, the surface roughness of the surface ground by the grinding wheel 10 of the present invention was changed or deteriorated less than that of the surface ground by the conventional grinding wheel. Suppose a permissible maximum amount of the surface roughness Rz is 2 $\mu$m, the grinding wheel 10 has a tool life larger than a tool life of the conventional grinding wheel by about 35% of the tool life of the conventional grinding wheel. In the test in which the grinding operations with the grinding wheel 10 and the conventional grinding wheel were terminated when the respective ground amounts reached about 20 ($mm^2$/mm), a breakage or chipping was confirmed near each of the joint lines at which the corresponding adjacent pair of abrasive segment chips 14 are bonded to each other. It is noted that the unit of the ground amount, i.e., $mm^2$/mm represents a ratio of a cross sectional area of a ground portion of the workpiece, to a circumferential length of the outer circumferential surface of the grinding wheel.

Figure 5:
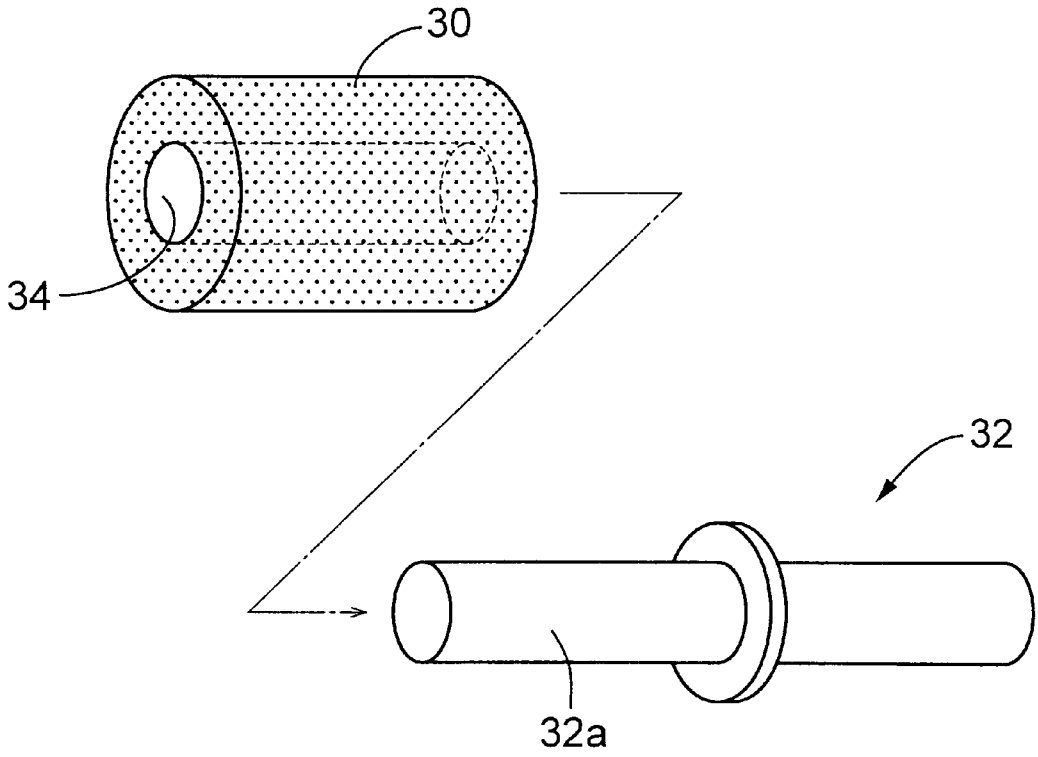
FIG. 5 is a perspective view of a tubular-body-type grinding wheel, which is constructed according to another embodiment of the invention.
Figure 6:
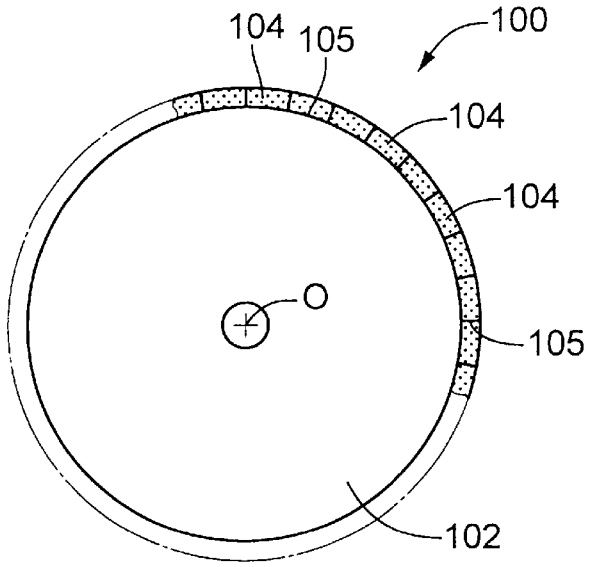
FIG. 6 is a front elevational view of a conventional segment-chip-type grinding wheel in which a multiplicity of abrasive segment chips are bonded to a base disk without provision of a sealing film.
Figure 7:
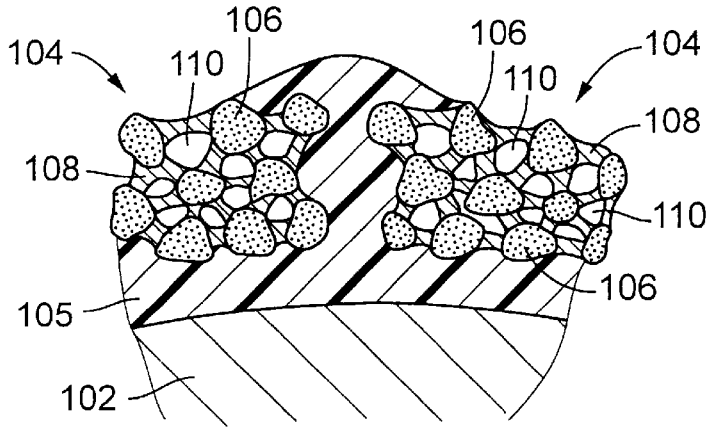
FIG. 7 PRIOR ART
FIG. 7 is a cross sectional view of an outer peripheral portion of the conventional segment-chip-type grinding wheel of FIG. 6.
Figure 8:
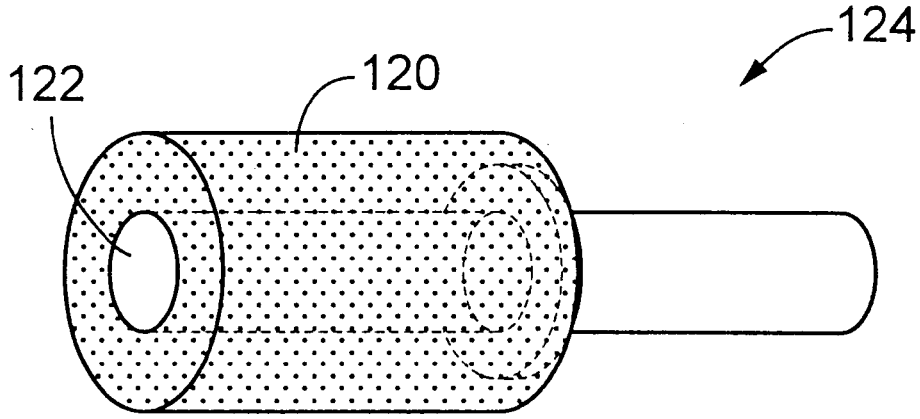
FIG. 8 PRIOR ART
FIG. 8 is a perspective view of a conventional tubular-body-type grinding wheel in which a tubular abrasive body is bonded to a cylindrical base body without provision of a sealing film.

FIG. 5 is a perspective view of a tubular-body-type grinding wheel, which is constructed according to another embodiment of the invention. This tubular-body-type grinding wheel includes a cylindrical base body in the form of an arbor 32, and an abrasive solid mass in the form of a tubular abrasive body 30 which is fitted on a fitting portion 32*a* of the arbor 32, such that the tubular abrasive body 30 is bonded to the fitting portion 32*a* with an adhesive. This tubular-body-type grinding wheel is substantially identical with the grinding wheel of FIG. 8 except that an inner circumferential surface of a mounting hole of the tubular abrasive body 30 is coated with a sealing film 34. Like the abrasive segment chips 14 of the segment-chip-type grinding wheel 10, the tubular abrasive body 30 has a vitrified CBN abrasive structure having a multiplicity of pores. Similarly, like the sealing film 24 of the segment-chip-type grinding wheel 10, the sealing film 34 is formed of a lead-based or tin-phosphate based glass as its major component, in a manner similar to the above-described sealing-film forming step of FIG. 3B.

In the present tubular-body-type grinding wheel, the sealing film 34 is formed on the inner circumferential surface of the mounting hole of the tubular abrasive body 30 at which surface the tubular abrasive body 30 is bonded to the fitting portion 32*a* of the arbor 32 with the adhesive, for thereby effectively preventing the adhesive from penetrating into the pores of the tubular abrasive body 30. That is, the formation of the sealing film 34 on the tubular abrasive body 30 is effective to prevent a reduction in the volume ratio of the pores to the abrasive grains in a radially inner portion of the tubular abrasive body 30. Therefore, even after a radially outer portion of the tubular abrasive body 30 is worn as a result of repeated use of the grinding wheel, namely, even after the outer circumferential surface of the grinding wheel becomes close to the fitting portion 32*a* of the arbor 32 as a result of reduction in the outside diameter of the grinding wheel, the grinding wheel can maintain its grinding capacity, without suffering from glazing on the outer circumferential surface of the grinding wheel and deterioration in the machining accuracy, which would be caused in the event that the pores of the tubular abrasive body 30 had been filled with the adhesive.

In the interest of clarifying technical advantages provided by the provision of the sealing film 34, the present inventors produced a tubular-body-type grinding wheel in which a tubular abrasive body having an outside diameter of 10 mm and an inside diameter of 6 mm was bonded to an arbor without provision of a sealing film between the tubular abrasive body and the arbor. This tubular-body-type grinding wheel could no longer serve to perform a grinding operation due to deterioration in the machining accuracy, when the outside diameter of the abrasive body was reduced to about 8 mm as result of wear of the abrasive body. That is, when the outside diameter was reduced to about 8 mm, a dense abrasive structure portion (in which the volume ratio of the pores to the abrasive grains was reduced due to penetration of the adhesive into the pores) was exposed to the outer circumferential surface of the tubular abrasive body. In contrast to this tubular-body-type grinding wheel, the above-described tubular-body-type grinding wheel, in which the sealing film 34 is provided between the tubular abrasive body 30 and the arbor 32, did not suffer from deterioration in the machining accuracy even when the outside diameter of the tubular abrasive body 30 was reduced to about 6 mm (substantially equal to the inside diameter of the tubular abrasive body), because the adhesive did not exposed to the outer circumferential surface of the tubular abrasive body 30 even when the outside diameter was reduced to about 6 mm.

While the presently preferred embodiments of the present invention have been illustrated above, it is to be understood that the invention is not limited to the details of the illustrated embodiments, but may be embodied with various other changes, modifications and improvements, which may occur to those skilled in the art, without departing from the spirit and scope of the invention defined in the following claims.

What is claimed is:

1. A method of bonding an abrasive solid mass to a member with an adhesive, wherein said abrasive solid mass has a porous abrasive structure in which a multiplicity of abrasive grains are held together by a bonding agent, said method comprising:

a sealing-film forming step of forming a sealing film on a surface of said abrasive solid mass, for preventing said adhesive from penetrating into pores formed in said porous abrasive structure.

2. A method according to claim 1, further comprising a bonding step of bonding said abrasive solid mass to said member with said adhesive, by heating said adhesive up to a setting temperature, wherein said sealing film is formed of a material having a softening temperature which is lower than a softening temperature of said bonding agent and which is higher than said setting temperature.

3. A method according to claim 1, wherein said sealing film is formed of a material having a coefficient of linear thermal expansion of $(a\pm2)\times10^{-6}$ (/° C.) while said abrasive solid mass has a coefficient of linear thermal expansion of $a\times10^{-6}$ (/° C.), where "a" represents a value larger than 0 and smaller than 10.

4. A method according to claim 1, wherein said sealing film includes a lead based glass as a major component thereof.

5. A method according to claim 1, wherein said sealing film includes a tin-phosphate based glass as a major component thereof.

6. A method according to claim 1, wherein said sealing-film forming step includes:

a sub-step of preparing a mixture of a liquid and a powder including a lead based glass as a major component thereof;

a sub-step of applying said mixture onto said surface of said abrasive solid mass;

a sub-step of drying said mixture applied onto said surface of said abrasive solid mass; and a sub-step of heating said mixture up to a temperature that is higher than a softening temperature of said lead based glass, so that said sealing film is formed on said surface of said abrasive solid mass.

7. A method according to claim 1, wherein said sealing-film forming step includes:

a sub-step of preparing a mixture of a liquid and a powder including a tin-phosphate based glass as a major component thereof;

a sub-step of applying said mixture onto said surface of said abrasive solid mass;

a sub-step of drying said mixture applied onto said surface of said abrasive solid mass; and a sub-step of heating said mixture up to a temperature that is higher than a softening temperature of said tin-phosphate based glass, so that said sealing film is formed on said surface of said abrasive solid mass.

8. A method of manufacturing a grindstone which includes a base member, and at least one abrasive solid mass bonded to said base member with an adhesive, each of said at least one abrasive solid mass having a porous abrasive structure in which a multiplicity of abrasive grains are held together by a bonding agent, said method comprising:

a sealing-film forming step of forming a sealing film on each of said at least one abrasive solid mass, for preventing said adhesive from penetrating into pores formed in said porous abrasive structure.

9. A method according to claim 8, wherein said base member consists of a base disk, wherein said at least one abrasive solid mass consists of a plurality of abrasive segment chips arranged without spacing between each adjacent pair of said abrasive segment chips which are bonded at respective bonding surfaces thereof to each other by said adhesive, and wherein said sealing film is formed on said bonding surfaces of each adjacent pair of said abrasive segment chips in said sealing-film forming step, before each adjacent pair of said abrasive segment chips are bonded to each other.

10. A method according to claim 8, wherein said base member consists of a cylindrical base body, wherein said at least one abrasive solid mass consists of a tubular abrasive body mounted on said cylindrical base body such that said tubular abrasive body is bonded at a bonding surface thereof to said cylindrical base body by said adhesive, and wherein said sealing film is formed on said bonding surface of said tubular abrasive body in said sealing-film forming step, before said tubular abrasive body is bonded to said cylindrical base body.

11. A method according to claim 8, wherein said porous abrasive structure of each of said at least one abrasive solid mass consists of a vitrified abrasive structure in which cubic-crystal boron nitride (CBN) abrasive grains as said multiplicity of said abrasive grains are held together by a vitrified bond as said bonding agent.

12. A method according to claim 8, wherein said porous abrasive structure of each of said at least one abrasive solid mass consists of a vitrified abrasive structure in which diamond abrasive grains as said multiplicity of said abrasive grains are held together by a vitrified bond as said bonding agent.

* * * * *